United States Patent [19]

Getz

[11] 4,389,966

[45] Jun. 28, 1983

[54] APPARATUS FOR APPLYING HOT-MELT TO THREAD

[75] Inventor: John L. Getz, Blachly, Oreg.

[73] Assignee: Industrial Adhesive, Inc., Eugene, Oreg.

[21] Appl. No.: 330,372

[22] Filed: Dec. 14, 1981

[51] Int. Cl.[3] ..... B05C 3/12

[52] U.S. Cl. ..... 118/405; 118/DIG. 18

[58] Field of Search ..... 118/125, 405, DIG. 18, 118/429

[56] References Cited

U.S. PATENT DOCUMENTS

| | | | |
|---|---|---|---|
| 2,394,066 | 2/1946 | Kauth | 118/405 X |
| 2,880,698 | 4/1959 | Olson | 118/405 |
| 3,515,577 | 6/1970 | Irwin | 118/405 X |
| 3,654,897 | 4/1972 | Trattner et al. | 118/405 X |
| 3,898,953 | 8/1975 | Couture | 118/125 |

*Primary Examiner*—John P. McIntosh

*Attorney, Agent, or Firm*—Kolisch, Hartwell & Dickinson

[57] ABSTRACT

A device for applying hot-melt adhesive to a travelling length of string. The device includes an applicator plate assembly comprising a pair of abutting plates yieldably held against each other. A string-receiving passage defines between these plates receives string which travels through the applicator plate assembly.

8 Claims, 3 Drawing Figures

FIG. 1
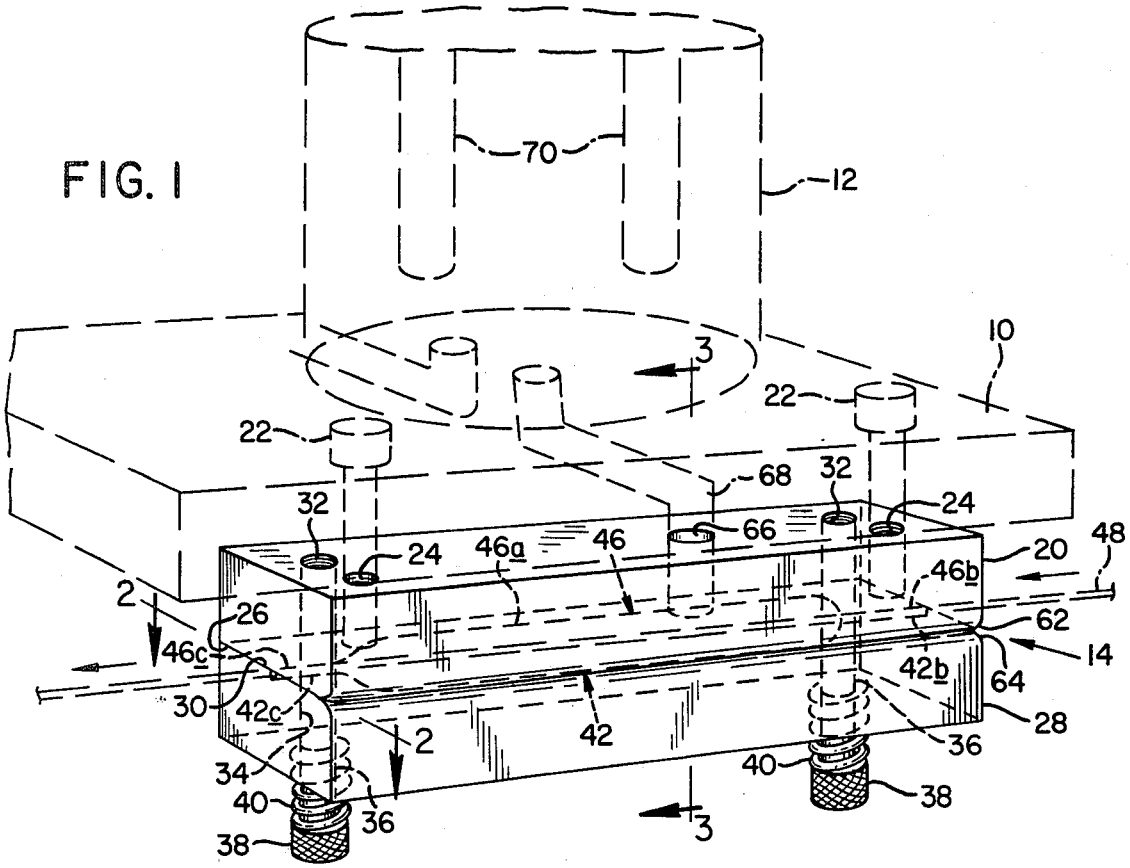
FIG. 2
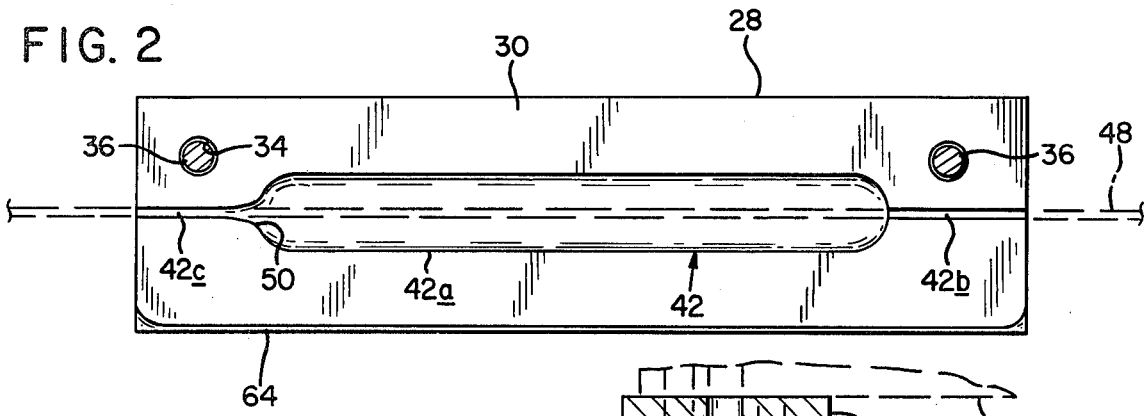
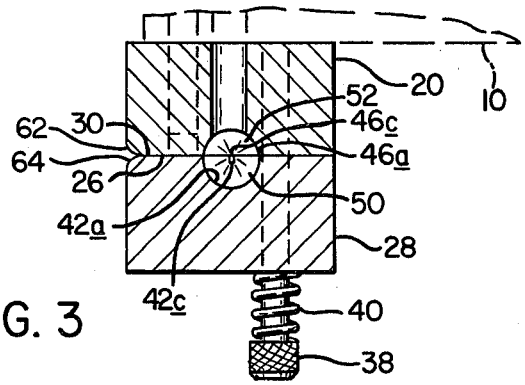
FIG. 3

APPARATUS FOR APPLYING HOT-MELT TO THREAD

BACKGROUND OF THE INVENTION

This invention relates to a device for heating string with the string extending as a strand travelling through the device. More particularly, the invention concerns an applicator for applying and impregnating a travelling string with a liquid, the liquid being rendered properly flowable through the application of heat.

Explaining a particular use of the device of the invention, and by this explanation it is not intended to exclude other uses where similar problems are encountered, in the manufacture of plywood, it is common to secure multiple side-by-side oriented pieces of veneer together with strings extending across the faces of the veneer and adhesively secured thereto. This renders the veneer pieces easier to handle, as when laying up a panel incorporating these veneer pieces. A string or thread commonly used in this manufacture is one impregnated with a hot-melt adhesive, such being readily secured to a veneer face by pressing the string while in a heated condition against the face of the veneer.

A number of different types of devices have been proposed for impregnating a string or thread with hot-melt adhesive. A drawback of many known devices is that they are difficult to set up with a string properly extending through the device. Some have required a needle for the purpose of so-called threading the device, but a needle is a loose article and tends to be lost. In other devices, if the string is not properly positioned, it tends to catch in the device and break. Complicating the problem is that the devices are frequently hot when being set up with string or yarn, meaning that extreme care must be used to avoid being inadvertently burned. Other problems associated with known devices are a tendency for leakage of the hot melt adhesive to occur or if adjusted to control such leakage, an insufficient amount of the hot-melt material impregnates the string being processed.

A general object of this invention is to provide a device for heating a travelling length of string or thread which is easily set up with a string extending through it, without the need to employ a needle or other aid to perform the threading process.

Another object is to provide an applicator for a thermoplastic material, such as a hot-melt adhesive, which produces good impregnation of a travelling length of string without attendant leakage of material.

A further object is to provide an applicator for applying a heated, thermoplastic material to a travelling length of string or yarn, which is easily set up or threaded with a piece of string without inadvertent breakage in the string occurring.

The applicator contemplated accomplishes uniformly good impregnation of a travelling string with such travelling at relatively high speeds. Adjustments are readily made in the applicator to accommodate the handling of different string sizes, i.e., diameters.

These and other objects and advantages are attained by the invention, which will become more fully apparent from a reading of the following description, which is to be taken in conjunction with the accompanying drawings, wherein:

BRIEF DESCRIPTION OF THE DRAWINGS

FIG. 1 is a perspective view of a device for impregnating a travelling length of string with hot-melt adhesive, as contemplated in an embodiment of the invention;

FIG. 2 is a view of an applicator plate in the device, taken generally along the line 2—2 in FIG. 1, and FIG. 3 is a cross-sectional view, taken generally along the line 3—3 in FIG. 1.

DETAILED DESCRIPTION OF A PREFERRED EMBODIMENT OF THE INVENTION

The embodiment of the invention illustrated in the drawings takes the form of an applicator for applying so-called hot-melt adhesive to a travelling length of thread or string. In general terms, the applicator, and referring to FIG. 1, includes a stationary, metallic, and thus heat-conductive plate 10, a vessel 12 mounted on the plate which provides a reservoir for holding a supply of the hot melt material, and an applicator plate assembly 14 secured to the underside of plate 10, which is operable to impregnate a length of string or thread passing therethrough with the hot-melt adhesive.

The applicator shown includes one applicator plate assembly beneath and adjacent one margin of plate 10. If desired, more applicator plate assemblies may be included, as by providing another plate assembly beneath and adjacent the opposite margin of plate 10. The construction and operation of an applicator plate assembly are as described in connection with assembly 14.

Thus, and with reference to applicator plate assembly 14, such comprises an elongate fixed or stationary plate 20, which is the upper plate in the assembly. The plate is metallic and thus heat-conductive, and bears against the underside of plate 10 so as to be in thermally conductive relationship with plate 10. The plate is secured in position by screws or fasteners 22 extending downwardly through accommodating bores provided in plate 10 and having lower threaded extremities screwed into internally threaded bores 24 provided against opposite ends of plate 20. Extending along the bottom of plate 20 is an essentially flat contacting face 26.

Disposed against the underside of plate 20 is another elongate plate 28 which may have essentially the same dimensions as plate 20. This plate is also metallic and thus heat-conductive. The plate has an upper, essentially flat contacting face 30 which abutts contacting face 26 of the upper plate.

Plate 28 is yieldably mounted on the underside of plate 20 to permit slight spreading of the lower plate from the upper plate. Specifically, extending upwardly into the upper plate, adjacent opposite ends and one side of the plate, are threaded bores exemplified by bore 32. Aligned with these bores and extending through plate 28 are smoothed-surfaced bores 34. Fasteners, i.e., screws 36, extend with very slight clearance through bores 34 and have their threaded ends screwed into threaded bores 32. Screws 36 have knurled enlarged ends 38 enabling them to be turned by hand. A coil spring 40 encircling the shank of each groove and interposed between its knurled end and the underside of plate 28 yieldably biases the plate upwardly against the underside of upper plate 20.

Extending along the upper side of plate 28, and bounded on either sides by portions of its contacting face, is an elongate channel 42. Channel 42 has an elongate enlarged central portion **42*a* and end segments 42*b*** and 42c of substantially lesser width and depth. Ends 42b, 42c of the channel throughout most of their lengths are uniformly cross-sectioned, and as can be seen in FIG. 3, the channel between its sides is bounded by arcuately curved surfaces.

The under side of plate 20 is also provided with an elongate channel, in this instance channel 46, including an elongated enlarged central portion 46a and end segments 46b, 46c of reduced depth and width. With the plates mounted against each other, the end segments of the channel in the upper plate register with and open to the end segments of the channel in the lower plate. The enlarged central section of the upper channel opens to and forms an upper extension of the enlarged central section of the lower channel.

The channels in the upper and lower plates together define a string-receiving passage extending between the plates and bounded on opposite sides by portions of the contacting faces of the plates. The central segments of these channels together define an elongate chamber for holding a supply of hot-melt material.

String or thread processed by an applicator plate assembly, such as that shown in 48, extends through the string-receiving passage and the enlarged supply chamber which is formed intermediate the ends of this passage. Travel of the string is from left to right in FIG. 1, and out the left end of the supply chamber, this end, therefore, constituting the discharge end of this chamber.

It will be noted with reference to FIGS. 2 and 3 that the discharge end of this chamber is formed by funnel-shaped surfaces presented by the two plates, designated at 50 and 52, which incline toward each other progressing outwardly from the discharge end of the chamber. By reason of this configuration, hot-melt material which impregnates and adheres to the string with such travelling through the supply chamber tends to be pulled with the string with such travelling from the supply chamber, and to be extruded into portions of the string-receiving passage located downstream from the discharge end of the supply chamber. As a result, the string leaving the plate assembly carries with it a good supply of the hot-melt material. The funnel-shaped surfaces inhibit a tendency for material to be wiped from the string on such leaving the enlarged central supply chamber.

It should also be noted that the string-receiving passage, in portions on either side of the enlarged central supply chamber, are formed, for the most part, in lower plate 28, with sections 42b, 42c having substantially greater depth than portions 46b, 46c in the upper plate 20. As contemplated by this invention, the lower plate may be removed through unscrewing screws 36, and other plates be substituted therefore, having channel segments 42b, 42c of somewhat greater, or somewhat lesser, cross-sectional area. In this way, the plate assembly is best adapted to handle string or thread of different diameters. With the major portion of the end segments of the string-receiving passage defined in the lower plate, and with proper contouring of the lower plate, an approximately round thread-receiving passage is producable in the end segments even though different cross-sectional areas are selected in different lower plates 28.

The upper and lower plates, along their lengths, and along margins of the plates opposite the margins adjacent screws 36, are provided with rounded corners 62, 64. The rounds of these corners meet smoothly with contacting faces 26, 30, respectively. The rounded corners provide a beveled entry to the abutting contacting faces immediately laterally inwardly of the rounded corners.

With the construction described, it is an easy matter to place a length of string or thread with such extending between the plates and lodged within the string-receiving passage defined between the plates. The operator need only to tighten an expanse of string, as between his hands, and with placing such within the beveled entry provided by rounded corner 62, 64, then move the string laterally inwardly between the plates, finally to locate the string in the string-receiving passage provided. A typical string may have a diameter of 0.015 inch, which is not appreciable, and the string itself is somewhat compressible. As a result, with insertion of the string, there is minimal separation of the plates. Spreading apart or separation of the plates to a very slight extent does occur, however, and this is yieldably accommodated by the springs encircling the screws earlier described.

Hot-melt adhesive in vessel 12 is supplied to the supply chamber through bore 66 extending through the upper plate 20, and passage 68 formed in plate 10, which has one end for communicating with the upper end of bore 66 and its other end with communicating with the interior of vessel 12.

Means is provided for heating the vessel, and thus the contents of hot-melt material within the vessel. Such means may take any of conventional forms. In the particular form of the invention illustrated, electric heating elements are depicted at 70 which heat the sides of the vessel and material within the vessel. Heat from the vessel is transmitted by conduction to plate 10 underlying it. Heat by conduction in turn travels from this plate to the plates making up applicator plate assemblies secured to the under side of plate 10.

Using an applicator of the type above-described, superior impregnation of string travelling through the applicator plate assembly at relatively high speed is obtained. By way of example, applicators that I have prepared have produced good results with string travel at speeds from three to six feet per second. The enlarged supply chamber defined between the ends of the thread-receiving passage holds a considerable volume of material, which produces good impregnation of the string even though such is travelling at high speed. With string on leaving the discharge end of the supply passage pulling material with it, and with, in effect, extrusion of material from the discharge end of the supply chamber, the string leaves the applicator fully impregnated and without wiping of material. String or thread travels through the applicator plate assembly with minimal resistance to its travel. Threading of the applicator assembly is easily performed without the need for a needle or other tool. String breakage occurring during the threading operation or during operation of the applicator assembly is minimal.

While embodiments of the invention have been described herein, it should be obvious that variations and modifications are possible without departing from the invention.

It is claimed and desired to secure by Letters Patent:

1. A device for heating an elongate string by reason of the string moving through a heated pool of liquid comprising:

a plate assembly including first and second heat-conductive elongate plates, each having a contacting face extending therealong, and means mounting the plates with their contacting faces abutting and opposite each other;

a channel extending along the contacting face of the first plate and another channel extending along the contacting face of the second plate, said channels being opposite and opening to each other and together defining a string-receiving passage extending between the plates with ends of the passage opening to opposite extremities of the plate, said passage being bounded on opposite sides by said contacting faces, the means mounting the plates including biasing means yieldably maintaining said contacting faces in pressure contact and accommodating relative movement of the plates away from each other whereby their contacting faces spread apart, a beveled entry formed in at least one plate leading to the abutting faces of the plates said channels between their ends having elongate expanses with cross-sectional areas substantially greater than the cross-sectional area of the remainder of the channels, said expanses being opposite and in complementary registration with each other and together forming an elongate chamber for holding a heated pool of liquid which chamber is closed on opposite sides by reason of said contacting faces being resiliently held in pressure contact, and heater means for applying heat to at least one plate which is effective to heat the pool of liquid inside the chamber by reason of the heat conductive nature of the plates and the pressure contact of said faces.

2. The device of claim 1, wherein said beveled entry comprises a rounded shoulder extending along at least one plate.

3. The device of claim 1, which further includes liquid supply-passage means in one of said plates communicating with said chamber.

4. The device of claim 1, wherein said first plate is a stationary plate, said heater means is mounted so as to apply heat directly to said first plate and through said first plate to said second plate, and the means mounting the plates comprises removable fastener means extending between the plates mounting the second plate on the first plate, the fastening means supporting said biasing means, said second plate being removable from the first plate with removal of the fastener means.

5. The device of claim 4, wherein the string-receiving passage adjacent the ends thereof is formed, for the most part, by the channel extending along the contacting face of the second plate.

6. An applicator for applying a liquid material to a moving string comprising:

a stationary plate having a contacting face and a movable plate having a contacting face, means yieldably securing the movable plate against the stationary plate with said contacting faces opposite and abutting in pressure contact, an elongate string-receiving passage extending between the plates with ends of the passage opening to opposite extremities of the plate, said passage being partially defined along its length by surfaces in each of the plates and bounded on opposite sides by said contacting faces, said passage in a region located between the ends of the passage having a cross-sectional area substantially greater than the cross-sectional area of the passage at ends of the passage thus to form an elongate chamber for holding a pool of liquid, said chamber being closed on opposite sides thereof by reason of the contacting faces being in yieldable pressure contact, said yieldable means accommodating spreading of the movable plate from the stationary plate to provide between their said contacting faces an opening leading to said passage, and a beveled entry in at least one plate leading to the abutting contacting faces of the plates.

7. The apparatus of claim 6, wherein said beveled entry comprises a beveled shoulder extending substantially parallel to said passage along one plate.

8. A device for heating an elongate string by reason of the string moving through a heated pool of liquid comprising:

a first heat-conductive plate having a contacting face and a second relatively movable heat-conductive plate having a contacting face, both plates being heat-conductive, means yieldably securing the second plate against the first plate with said contacting faces opposite and abutting in pressure contact, an elongate string-receiving passage extending between the plates with ends of the passage opening to opposite extremities of the plates, said passage being partially defined along its length by surfaces in each of the plates and said passage being bounded on opposite sides by said contacting faces, said passage in a region located between its ends having a cross-sectional area substantially greater than the cross-sectional area of the passage at ends of the passage, thus to form an elongate chamber for holding a pool of heated liquid, said chamber being closed on opposite sides thereof by reason of the contacting faces being in yieldable pressure contact, said yieldable means accommodating spreading of the second plate from the first plate to provide between their said contacting faces an opening leading to said passage, a beveled entry in at least one plate leading to the abutting contacting faces of the plates, and heater means for supplying heat to at least one plate which is effective to heat the pool of liquid in said chamber by reason of the heat-conductive nature of the plates and the pressure contact of said faces.

* * * * *